US009187202B2

(12) United States Patent
Kurihara et al.

(10) Patent No.: US 9,187,202 B2
(45) Date of Patent: Nov. 17, 2015

(54) SYNTHETIC RESIN BOTTLE

(75) Inventors: Goro Kurihara, Tokyo (JP); Takao Iizuka, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 1073 days.

(21) Appl. No.: 12/308,705

(22) PCT Filed: Jun. 19, 2007

(86) PCT No.: PCT/JP2007/062280

§ 371 (c)(1),
(2), (4) Date: Sep. 21, 2009

(87) PCT Pub. No.: WO2008/001643

PCT Pub. Date: Jan. 3, 2008

(65) Prior Publication Data

US 2010/0072168 A1 Mar. 25, 2010

(30) Foreign Application Priority Data

Jun. 29, 2006 (JP) ..... 2006-180141

(51) Int. Cl.
*B65D 90/02* (2006.01)
*B65D 1/02* (2006.01)
*B65D 23/10* (2006.01)

(52) U.S. Cl.
CPC ..... *B65D 1/0223* (2013.01); *B65D 23/102* (2013.01); *B65D 2501/0036* (2013.01); *B65D 2501/0081* (2013.01)

(58) Field of Classification Search
USPC ..... 215/384, 398; 220/374, 375, 755
See application file for complete search history.

(56) References Cited

U.S. PATENT DOCUMENTS

| | | | | | |
|---|---|---|---|---|---|
| 1,602,391 | A | * | 10/1926 | Creaver | 215/384 |
| D81,679 | S | * | 7/1930 | Webber | D9/566 |
| 2,018,878 | A | * | 10/1935 | Stein | 215/383 |
| 2,022,520 | A | * | 11/1935 | Philbrick | 215/384 |
| 4,890,752 | A | * | 1/1990 | Ota et al. | 215/384 |
| 5,226,550 | A | * | 7/1993 | Mikolaitis et al. | 215/384 |

(Continued)

FOREIGN PATENT DOCUMENTS

| | | |
|---|---|---|
| JP | A-8-230856 | 9/1996 |
| JP | U-3061042 | 6/1999 |

(Continued)

OTHER PUBLICATIONS

Machine translation of JP 2005088973.*

*Primary Examiner* — Jeffrey Allen
(74) *Attorney, Agent, or Firm* — Oliff PLC

(57) ABSTRACT

This invention intends to provide a large-size bottle that can be held firmly with a hand in simple handling. This can be achieved by fitting the thumb and a co-working finger into place and stopping them from sliding upward and laterally along the body wall, and also by stopping other fingertips from sliding laterally. A pair of grips 8 is formed in opposed walls of the body 4, and each grip 8 comprises a main recession 9 having a relatively large depth and an auxiliary recession 13 extending downward from this main recession 9. Fingertips are stopped by the main recession 9 from sliding upward and laterally, and are also stopped by the auxiliary recession 13 from sliding predominantly in the lateral direction. Since the thumb and all fingers are utilized for bottle handling, the bottle 1 is held firmly and stably with a hand.

6 Claims, 8 Drawing Sheets

(56) References Cited

U.S. PATENT DOCUMENTS

| | | | | | |
|---|---|---|---|---|---|
| 5,341,946 | A * | 8/1994 | Vailliencourt et al. | 215/381 |
| 5,381,910 | A * | 1/1995 | Sugiura et al. | 215/398 |
| 5,472,105 | A * | 12/1995 | Krishnakumar et al. | 215/384 |
| 5,971,184 | A * | 10/1999 | Krishnakumar et al. | 215/384 |
| 6,164,474 | A * | 12/2000 | Cheng et al. | 215/384 |
| 6,513,669 | B2 * | 2/2003 | Ozawa et al. | 215/381 |
| 6,739,467 | B2 * | 5/2004 | Saito et al. | 215/384 |
| 6,749,075 | B2 * | 6/2004 | Bourque et al. | 215/384 |
| 6,796,450 | B2 * | 9/2004 | Prevot et al. | 215/381 |
| 6,814,248 | B2 * | 11/2004 | Beck et al. | 215/384 |
| 6,964,347 | B2 * | 11/2005 | Miura | 215/384 |
| 6,981,604 | B2 * | 1/2006 | Iizuka et al. | 215/381 |
| 7,350,657 | B2 * | 4/2008 | Eaton et al. | 215/384 |
| 7,552,834 | B2 * | 6/2009 | Tanaka et al. | 215/381 |
| D605,952 | S * | 12/2009 | Inoi et al. | D9/560 |
| 7,712,620 | B2 * | 5/2010 | Nemoto et al. | 215/384 |
| 2001/0054597 | A1 * | 12/2001 | Ozawa et al. | 215/381 |
| 2004/0050851 | A1 * | 3/2004 | Ilzuka et al. | 220/669 |
| 2004/0134872 | A1 * | 7/2004 | Sasaki et al. | 215/384 |
| 2005/0040133 | A1 | 2/2005 | Saito et al. | |
| 2006/0054587 | A1 * | 3/2006 | Oguchi et al. | 215/381 |
| 2006/0207962 | A1 * | 9/2006 | Coley et al. | 215/384 |
| 2008/0277374 | A1 * | 11/2008 | Miura | 215/384 |
| 2009/0101660 | A1 * | 4/2009 | Matsuoka | 220/608 |
| 2009/0289028 | A1 * | 11/2009 | Sasaki et al. | 215/384 |
| 2009/0321385 | A1 * | 12/2009 | Oguchi et al. | 215/384 |

FOREIGN PATENT DOCUMENTS

| | | | |
|---|---|---|---|
| JP | A-2003-165518 | 6/2003 | |
| JP | A-2004-1847 | 1/2004 | |
| JP | 2005088973 A * | 4/2005 | B65D 1/02 |
| JP | A-2005-112383 | 4/2005 | |
| JP | A-2007-168814 | 7/2007 | |

* cited by examiner

SYNTHETIC RESIN BOTTLE

TECHNICAL FIELD

This invention relates to a large-size synthetic resin bottle, in which no depressurization occurs inside the bottle after it has been filled with contents and sealed, and particularly to a synthetic resin bottle which is quite easy to hold with a hand under a condition that the bottle has been filled with the contents and thus has an increased weight.

BACKGROUND ART

Synthetic resin bottles made of polyethylene terephthalate resins (hereinafter referred to as PET resins) have been widely used in the past as the containers for various drinks and foods. Bottles in a large size with a capacity of 2 liters may be provided with a handle to hold the bottle firmly with a hand, depending on the purposes of use.

Even if the handle is not provided, sometimes a waist portion is provided to make it easy to get hold of the body of the bottle with a hand. For example, bottles are known to have such construction that dents to be used as finger stops are formed in parts of the waist portion which is disposed at a middle height of the body.

The representative construction of a prior-art bottle has dents for use as finger stops, and the dents are formed at a middle height of the body of the bottle. These dents comprise groove-like grips disposed in at least opposed side walls of the body of the bottle. In addition, a dent in a shape of a lateral groove for placing a medicinal finger and another dent for placing a small finger are disposed at a certain space between the dents in one of the opposed body walls positions downward from the grip.

[Patent Document 1] Patent Application No. 2005-112383

In the case of the above-described prior art, the bottle is provided with a dent in the shape of a lateral groove for placing a medicinal finger and another dent for placing a small finger of a hand, in addition to the lateral groove-like grips for placing the thumb and the middle finger of the same hand, i.e., those fingers playing a major role in getting hold of the bottle with a hand. These dents enable the medicinal finger and the small finger, too, to be of help to the gripping action, together with the thumb and the middle finger, when the bottle is held with a hand. As a result, the bottle can be firmly and stably held with a hand.

Each grip comprises a first groove and a second groove which is shallower than the first groove, and the second groove is disposed on both sides of the first groove. Stable gripping force is obtained when the thumb and the middle finger fit in with a step formed on the boundary between the first and second grooves.

DISCLOSURE OF THE INVENTION

Problems to be Solved by the Invention

However, in the case of the above prior art, tips of the thumb and fingers placed in the grips and the dents are apt to be stopped less in the lateral direction, because the grips and the dents for finger placement have basically a lateral groove structure. As a result, fingertips of the bottle-grasping hand tend to slide along the lateral grooves when the person tilts the bottle to pour out the contents. Thus, the slippery grip causes a problem that bottle handling gets unstable at the time of pouring out the contents.

The step between the first groove and the second groove of the grip is supposed to form a finger stop for the finger placed in the grip. But this step cannot be of a large size because the step is located in the bottom of a narrow circumferential groove and because the first groove has a dented structure. Therefore, it is difficult for this step to bring out large finger stop strength.

Because both dents for finger placement were disposed in positions vertically spaced from each other in prior art, it turns out that the posture of the hand used in holding the body of the bottle is limited to a certain degree, as determined by the layout of this dent for finger placement. Thus, there arises a problem in that the bottle-grasping movement of the hand becomes troublesome.

The present invention has been made to solve the above-described problems found in prior art. A technical problem of this invention is to fit the thumb and a co-working finger into place and to stop them from sliding upward and laterally along the body wall, noting that the thumb and the co-working finger play a major gripping role when the bottle is held with a hand. Another technical problem is to stop other fingertips from sliding laterally along the body wall. An object of this invention is to provide a large-size bottle that can be held stably with a hand in simple handling.

Means of Solving the Problems

The large-size bottle of this invention made of a synthetic resin comprises a cylindrical body closed at a lower end to form a bottom, and a neck connected to a shoulder which in turn is connected to an upper end of the body. The bottle also comprises grips disposed in the central parts of a pair of opposed body walls, each grip comprising a main recession and an auxiliary recession, both of which are formed by denting an opposed body wall.

The main recession and the auxiliary recession constituting a grip are formed in such sizes that the tips of the thumb and fingers of the body-holding hand can be easily fitted into place.

The main recession of each grip is formed under the construction that forms a first finger-stop mechanism where the tips of the thumb and the co-working finger are stopped from sliding upward and laterally as the fingertips are caught in this first functional portion. In other words, the main recession is molded into a depth that affords to form this first finger-stop mechanism.

The auxiliary recession of each grip extends downward from the main recession, and is dented in a similar way so as to form a second finger-stop mechanism where the fingers placed therein are stopped from sliding laterally as the fingertips are caught by this second functional portion.

The main recession of the grip is adapted to receive the thumb and the index finger or the middle finger of a hand. It is noted that the thumb and a co-working finger play a major role in taking hold of a bottle. When the bottle is held up with a hand, both the thumb and the index finger or the middle finger are stopped from sliding upward as the fingertips are caught by the first finger-stop mechanism, and stable uplift of the bottle is carried out.

The auxiliary recession of the grip is adapted to receive at least the medicinal finger and the small finger. By pressing fingertips against this auxiliary recession, one can stabilize the position of the bottle in one's hand. Fingertips are prevented from sliding laterally as they are caught by the second finger-stop mechanism of the auxiliary recession and by the first finger-stop mechanism of the main recession. With these finger-stops, the bottle can be tilted stably and without trouble when the contents are poured out.

The thumb and the co-working finger are placed respectively in the main recessions, and play a major role in holding up the bottle. The fingers placed in the auxiliary recession play a supplementary role, such as controlling unnecessary swing of the bottle that has been held up with a hand. Thus, the thumb and all fingers cooperate to support the bottle in its tilted position when the bottle is lifted up with a hand and is tilted to pour out the contents.

The main and auxiliary recessions of each grip are formed integrally in an overlapping manner. Even if either recession is given a large depth, that recession is not dented locally, but instead, there occurs local drawing when the bottle is blow molded or biaxially drawn and blow molded. Thus, there is no case of structural inconvenience for the bottle.

This means that the main and auxiliary recessions have a large allowable range of depths, which enable the grip to be formed freely at depths suitable for the bottle.

Another construction of this invention is that the auxiliary recession has shallower depth than the main recession has.

In the case where the auxiliary recession has a shallower depth than the main recession, the shallowness of the auxiliary recession allows average depth of the entire grip to be reduced, and hence it becomes possible to mold the grips without any trouble.

According to another construction of this invention, the body of the bottle has a substantially cylindrical shape with a substantially rectangular cross section. Each grip is formed in a flat long-side wall of the bottle.

If the grips are formed on opposed long-side walls of the rectangular body, the palm of a body-holding hand tightly enfolds a flat short-side wall having a smaller width. Even a large-size bottle comes to be held easily with a hand by adjusting he width of the long-side wall and the width of the short-side wall of the body.

According to another construction of this invention, the main recession of the grip comprises a surrounding bank and a most recessed wall. The surrounding bank forms the first finger-stop mechanism as the bank goes down and grows narrower near the most recessed wall. A surrounding ridge having a low projecting height is disposed on this most recessed wall, which is connected peripherally to the surrounding bank.

In the case where the main recession of the grip comprises the surrounding bank and the most recessed wall which is provided with a low surrounding ridge, the surrounding bank, a main constituent of the main recession, serves as the first finger-stop mechanism. In this case, the main recession having the first finger-stop mechanism can be easily formed. When the thumb or a finger is placed in a main recession, the cushion of the thumb or the finger is pressed tightly against the most recessed wall. Since at that time the finger cushion is caught by the surrounding ridge, this catch reinforces he finger-stop action of the main recession.

According to another construction of this invention, the second finger-stop mechanism of the auxiliary recession comprises a first slope formed on the periphery of this recession and a second slope formed by denting a central recessed wall in a central area into a vertically long shape so that the second slope surrounds this central recessed wall In the case where the second finger-stop mechanism of the auxiliary recession is formed by the first slope and the second slope, fingers are stopped by either the first or second slope, whichever the fingers can be stopped easily, when a bottle is held with a hand. Because of these slopes, the body of the bottle can be held effortlessly with a hand.

According to another construction of this invention, the second finger-stop mechanism of the auxiliary recession comprises at least two concave portions, which are disposed vertically with one on top of the other. Each concave portion in a spherical arc shape has a dented arc face, with which a cushion of a finger fits in.

With the help of the second finger-stop mechanism of the auxiliary recession comprising at least two concave portions in the spherical arc shape, one can place a finger in the auxiliary recession so that the cushion of the finger fits into a dented arc face of such a concave portion. In this state, lateral finger stopping force is created between the second finger-stop mechanism and the fingertip. Not only that, but the fingertip is also stopped from sliding vertically]. Thus, the second finger-stop mechanism serves to reinforce the finger-stop work of the main recession that acts in the vertical direction.

According to another construction of this invention, a pair of short vertical ridge segments having a low projecting height is disposed in both side areas of each concave portion in the spherical arc shape, which constitutes the second finger-stop mechanism of the auxiliary recession.

Because the fingertip is stopped by these vertical ridge segments disposed in the side areas of each concave portion, these vertical ridge segments serve to reinforce the finger-stop work of the concave portion in the spherical arc shape, i.e., the second finger-stop mechanism, that prevents the finger from sliding in the lateral direction.

According to still another construction of this invention, the body is provided with a groove-like waist portion disposed around the body at its middle height. An upper portion of the main recession of each grip is designed to overlap the waist portion, and the main recession is given a larger depth than the waist portion has.

If this waist portion is disposed at upper ends of the main recessions of the grip, and is shallower than the main recessions, then it is possible to form a grip integrally with the waist portion. Thus, the grip having a large depth can be formed appropriately without any trouble. Since the tips of the thumb and a co-working finger placed in the main recessions of the grips are disposed at the positions corresponding to the groove of the waist portion, both the thumb and the finger are stabilized in their postures, and thus, the body is well balanced and easy to hold softly.

Effects of the Invention

This invention having the foregoing construction has the following effects:

The synthetic resin bottle of this invention can be handled safely and properly under a favorable condition because the user is at liberty to use the thumb and all fingers of the bottle-holding hand effectively without allowing the bottle to slip off the hand.

The grip has the construction in which the main recession is combined integrally with the auxiliary recession. Owing to his construction, the grip can be formed easily and reasonably at necessary depths and in a size adapted to the bottle size, without allowing any inconvenient local drawing to occur.

In another construction, the auxiliary recession has a shallower depth than that of the main recession. In that case, the average depth of the entire grip would become reduced. Naturally, it would be easy to form the grip in a dented state under favorable molding conditions.

In another construction, the grips are formed on opposed flat, long-side walls of the body of the bottle. With such grips, even a large-size bottle can be held easily with a hand. Therefore, it becomes easy to provide a large-size bottle that can be held effortlessly with a hand.

In another construction, the main recession of the grip comprises the surrounding bank and the most recessed wall provided with a low surrounding ridge. In that case, it is easy to form the main recession having the first finger-stop mechanism. Since the finger-stop action of the first finger-stop mechanism is reinforced, the bottle can be lifted up and held with a hand in a strong, smooth movement.

In another construction, the second finger-stop mechanism of the auxiliary recession is formed by the first slope and the second slope. In that case, fingers are stopped by either the first or second slope, whichever is easier to stop, when a bottle is held with a hand. Because of these slopes, the body of the bottle can be held readily with a hand, and the bottle can be handled easily.

In another construction, the second finger-stop mechanism of the auxiliary recession comprises at least two concave portions in the spherical arc shape. In that case, lateral finger stopping force is created between the second finger-stop mechanism and the fingertips. Not only that, but the fingertips are also stopped from sliding vertically. Thus, the second finger-stop mechanism serves to reinforce the entire finger-stop work of the first finger-stop mechanism, thereby resulting in a highly stabilized gripping movement of the bottle-holding hand.

In still another construction, a pair of short vertical ridge (尾根) segments having a low projecting height is disposed in both side areas of each concave portion in the spherical arc shape, which constitutes the second finger-stop mechanism of the auxiliary recession. Since in that case, each fingertip is prevented by these vertical ridge segments from sliding in the lateral direction, these ridge segments serve to reinforce the work of the second finger-stop mechanism. As a result, firm grip is obtained so that there is no lateral sliding movement.

In still another construction, the waist portion is disposed at upper ends of the main recessions of the grip, and is shallower than the main recessions. In that case, it is possible to form deep grips properly without any trouble. When the tips of the thumb and a co-working finger are placed in the main recessions of the grip, the thumb and the finger are stabilized in their postures of contact with the body, and thus, the body is well balanced and easy to hold softly. In this embodiment, deep grips can be molded favorably, and the bottle thus obtained can be held stably with a hand.

EXPLANATION OF CODES

Figure 1:
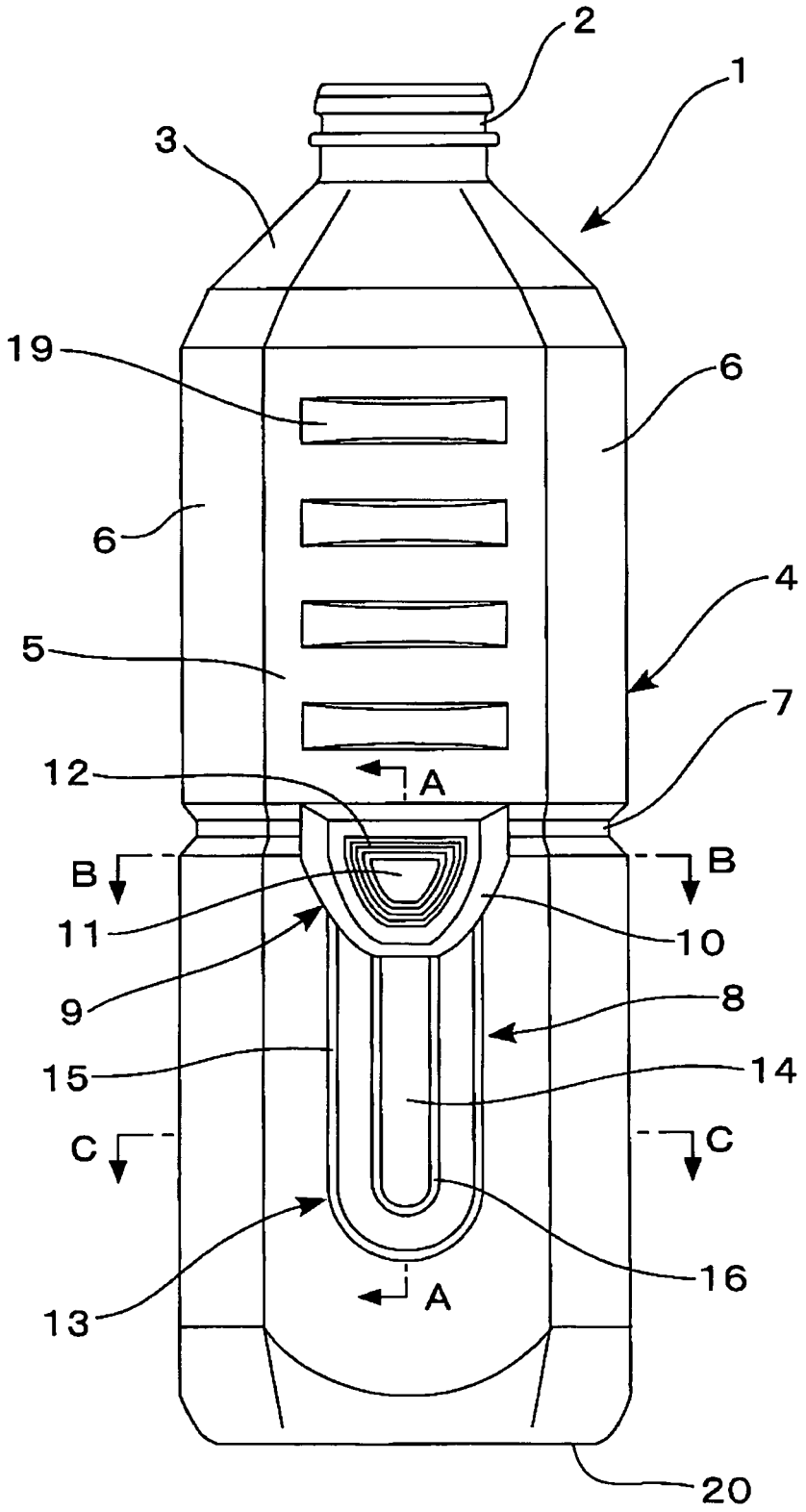
FIG. 1 is a front elevational view (正面図) of the entire bottle in the first embodiment of this invention.

1. Bottle
2. Neck
3. Shoulder
4. Body
5. Flat wall
6. Corner wall
7. Waist portion
8. Grip
9. Main recession
10. Surrounding bank
11. Most recessed wall
12. Surrounding ridge
13. Auxiliary recession
14. Central recessed wall
15. First slope
16. Second slope
17. Concave portion in the spherical arc shape
18. Vertical ridge segment
19. Lateral reinforcing rib
20. Bottom

PREFERRED EMBODIMENTS OF THE INVENTION

This invention is further described with respect to preferred embodiments, now referring to the drawings.

The synthetic resin bottle 1 in preferred embodiments shown in the drawings comprises a body having a substantially cylindrical shape with a substantially rectangular cross section 4, closed with an integrally disposed bottom 20 at a lower end; a shoulder 3 in a shape of a frustum of pyramid, disposed at an upper end of the body 4; and a short cylindrical neck 2 integrally disposed on the shoulder 3 and provided with a locking portion for an undercut engagement with a cap, disposed around an external wall surface of the neck.

The bottle 1 is a biaxially drawn, blow-molded container made of a PET resin for storing an edible oil and the like, and is characterized in that there occurs no pressure reduction inside the bottle 1 after the bottle has been filled with contents and sealed. This bottle has a nominal capacity of 2 liters. The body comprises four flat walls 5 and four chamfered walls linking adjacent flat walls, and has a chambered rectangular cross-sectional shape.

A dented groove-like waist portion 7 is disposed around the body 4 at its substantially middle height for the purpose of increasing the rigidity of the bottle 1.

A pair of grips 8, each comprising a main recession 9 and an auxiliary recession 13, is formed by making recessions in each flat long-side wall 5 over a central part of a lower half of the body down from the waist portion 7.

Figure 2:
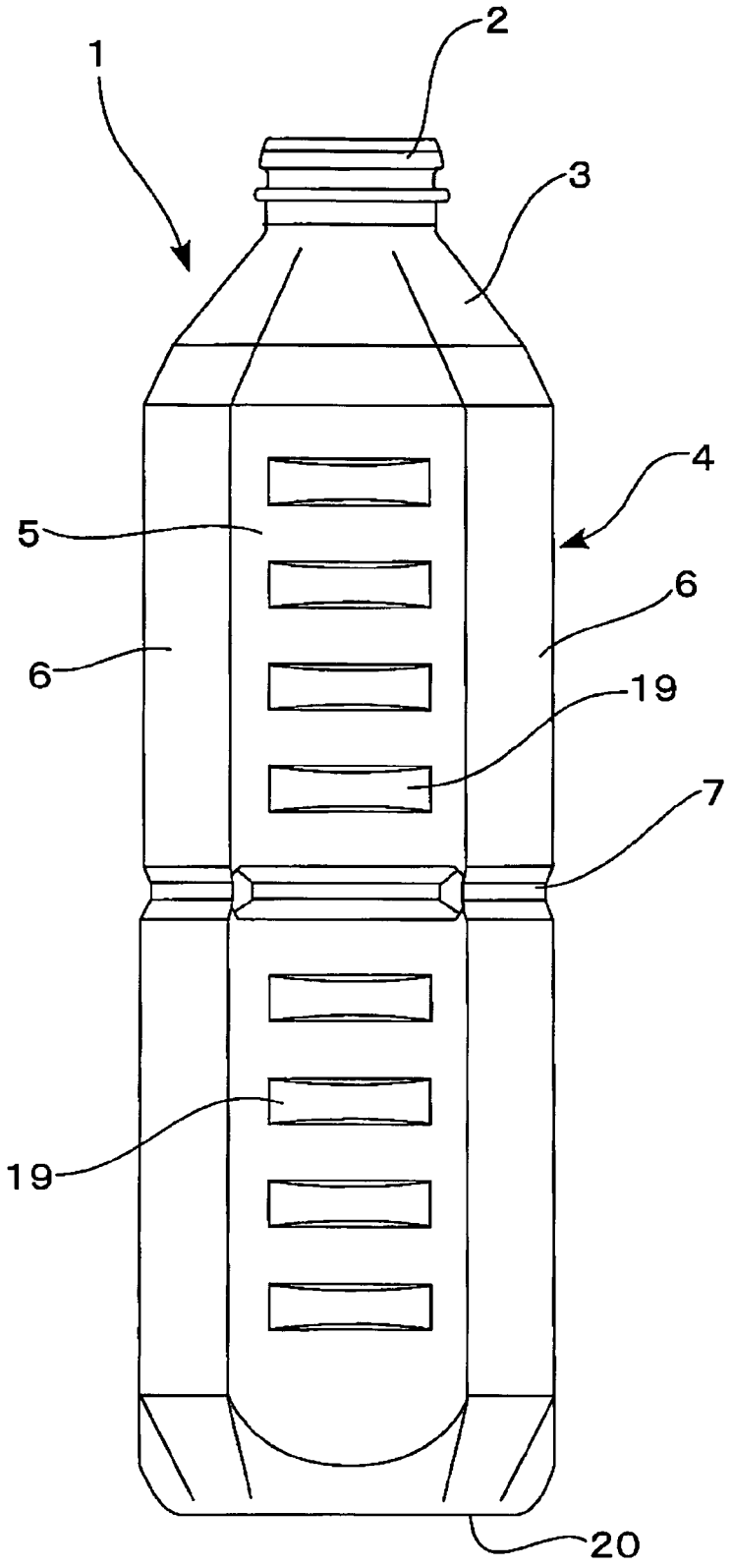
FIG. 2 is a side elevational view of the entire bottle in the first embodiment of this invention.
Figure 3:
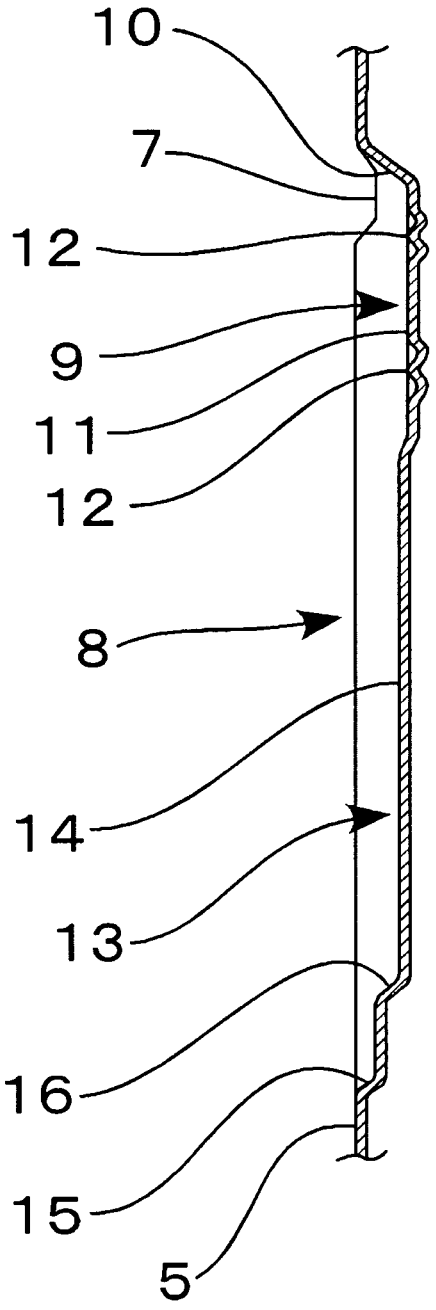
FIG. 3 is a partially enlarged vertical section of a body wall, taken from line A-A shown in FIG. 1.
Figure 4:
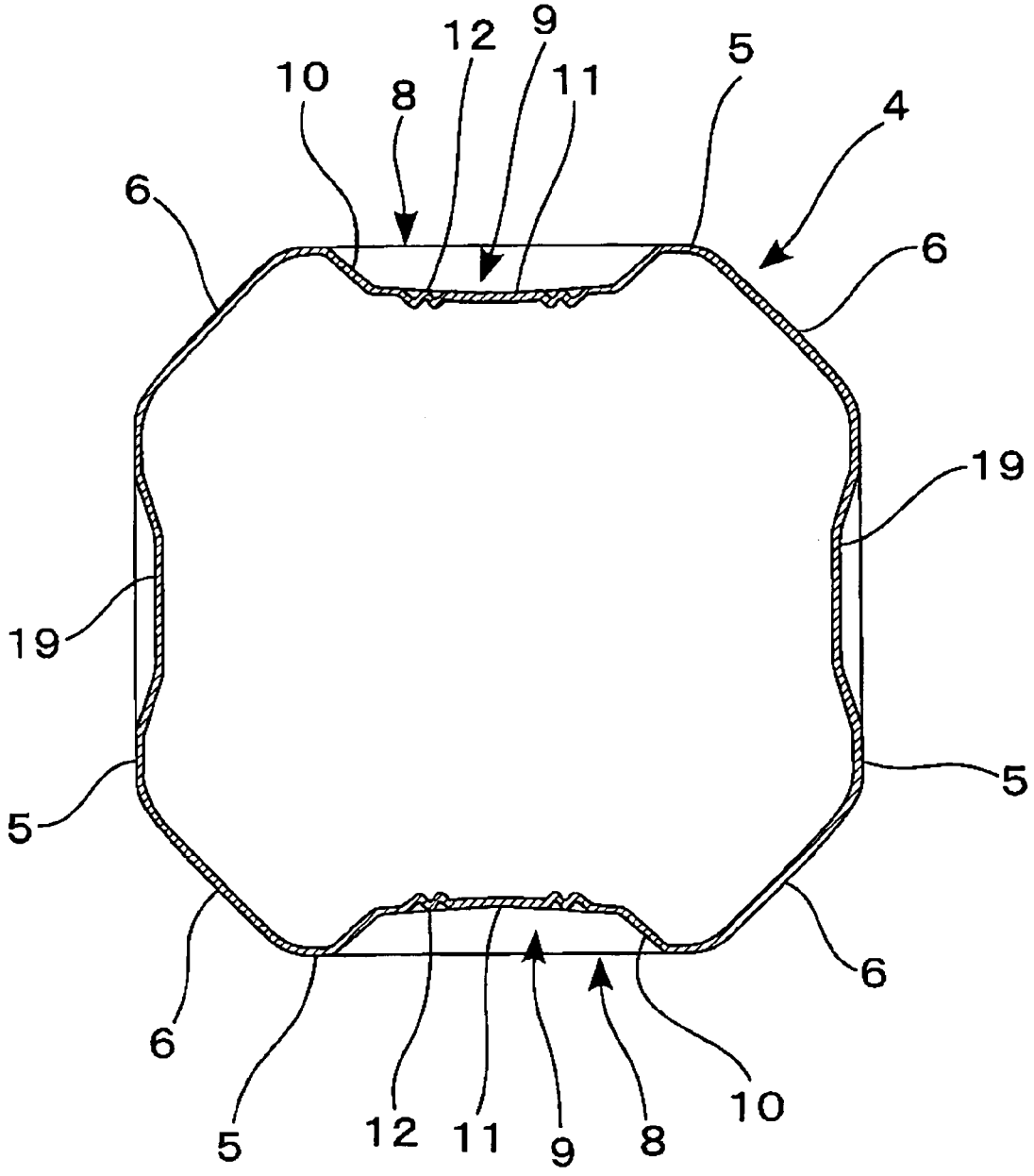
FIG. 4 is an enlarged cross-sectional view of a body wall, taken from line B-B shown in FIG. 1.
Figure 5:
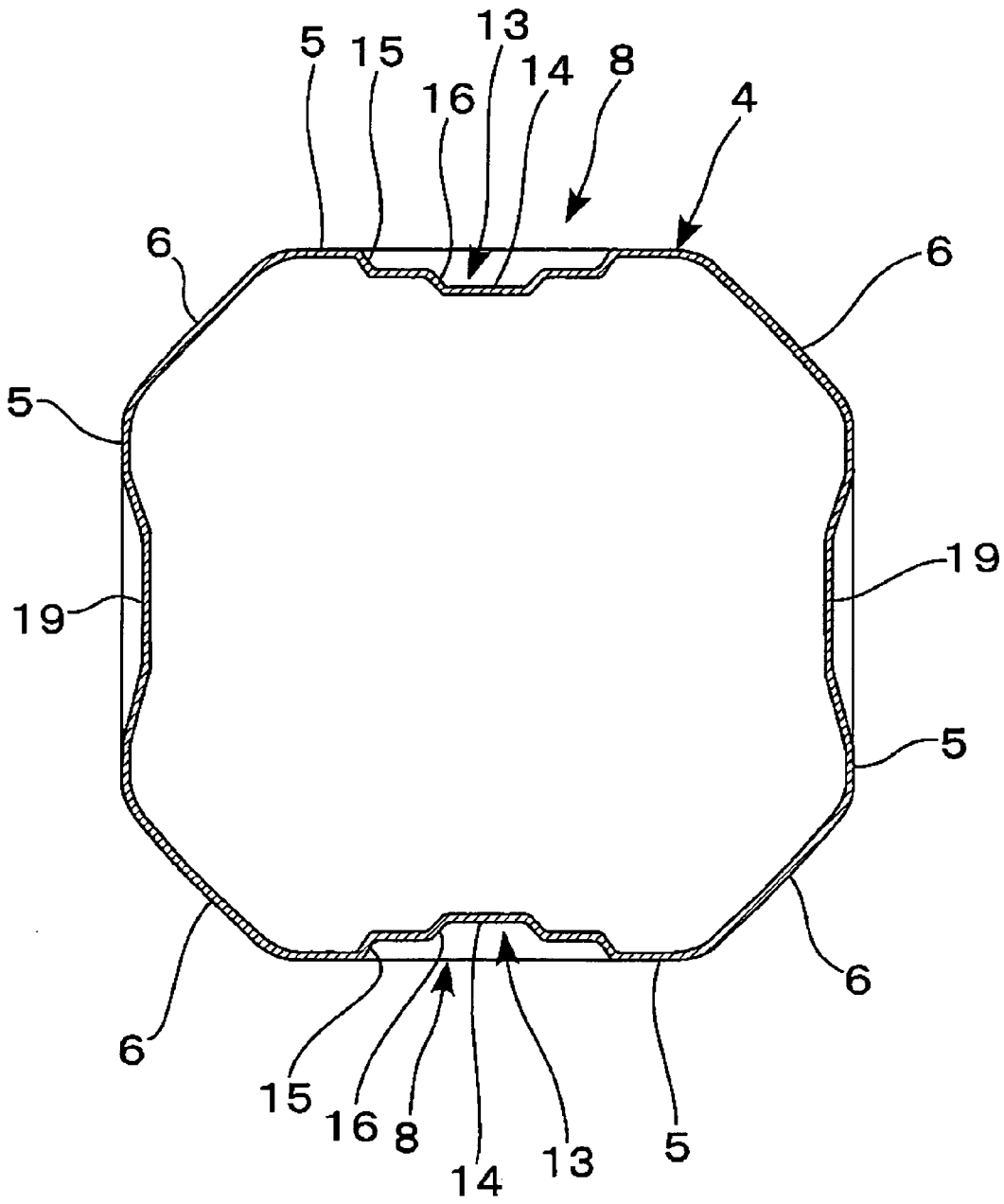
FIG. 5 is an enlarged cross sectional view of a body wall, taken from line C-C shown in FIG. 1.

The waist portion thus provided divides each flat wall 5 into an upper half and a lower half. Lateral flat-wall reinforcing ribs 19 are disposed in the remaining parts other than the parts where grips 8 are formed, i.e., in the upper half of the flat long-side walls 5 and in the entire short-side walls (See FIGS. 1, 2, and 6).

Figure 6:
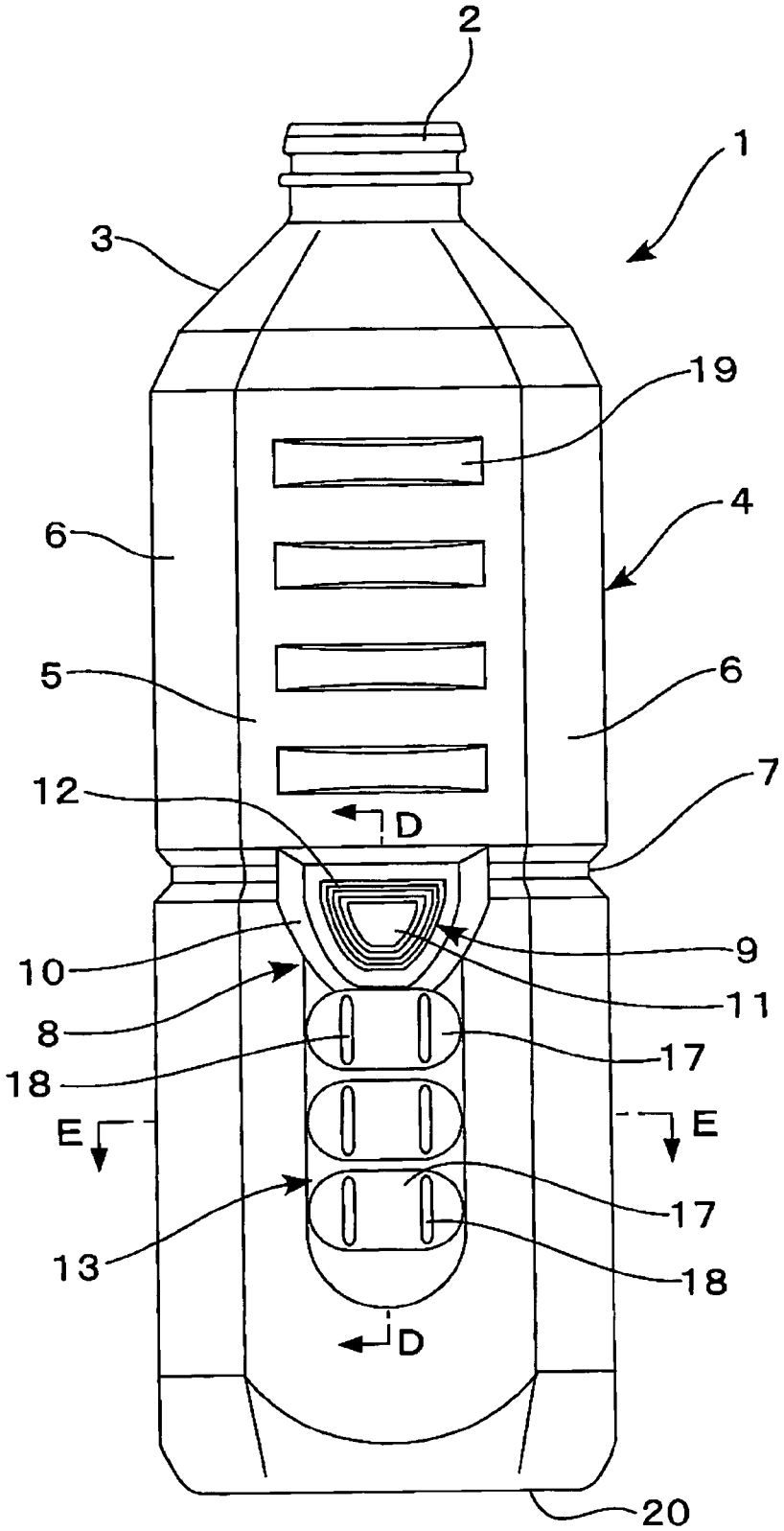
FIG. 6 is a front elevational view of the entire bottle in the second embodiment of this invention.
Figure 7:
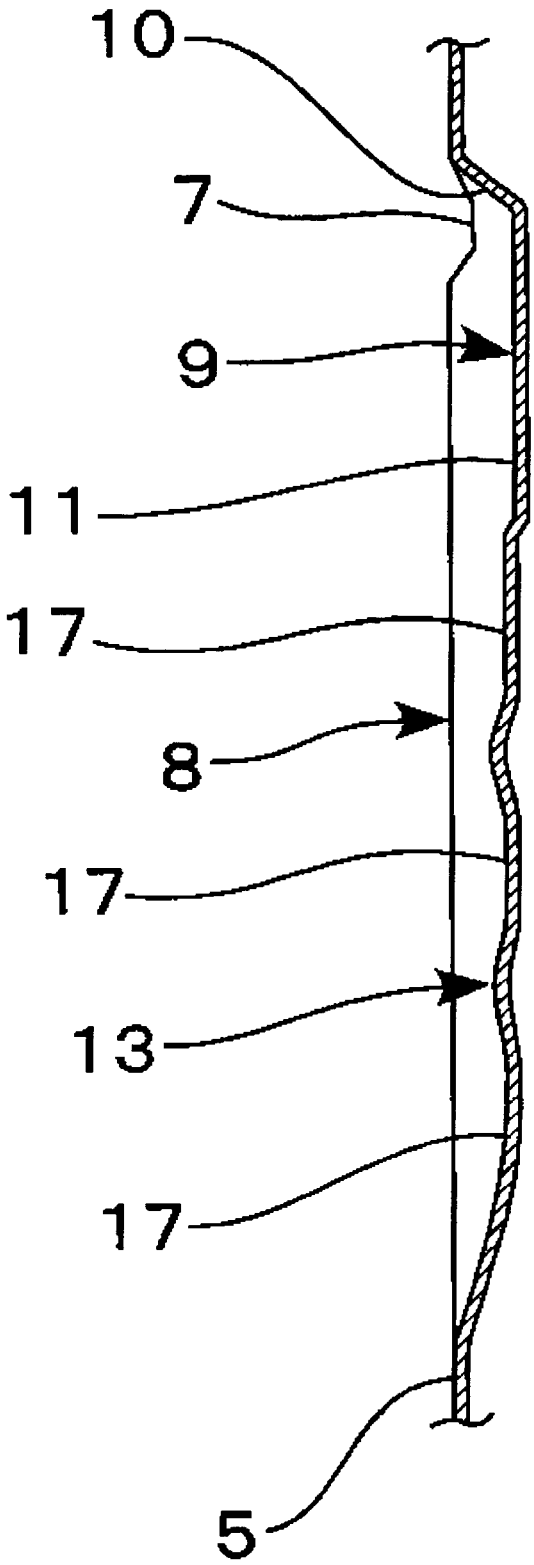
FIG. 7 is a partially enlarged vertical section of a body wall, taken from line D-D shown in FIG. 6.
Figure 8:
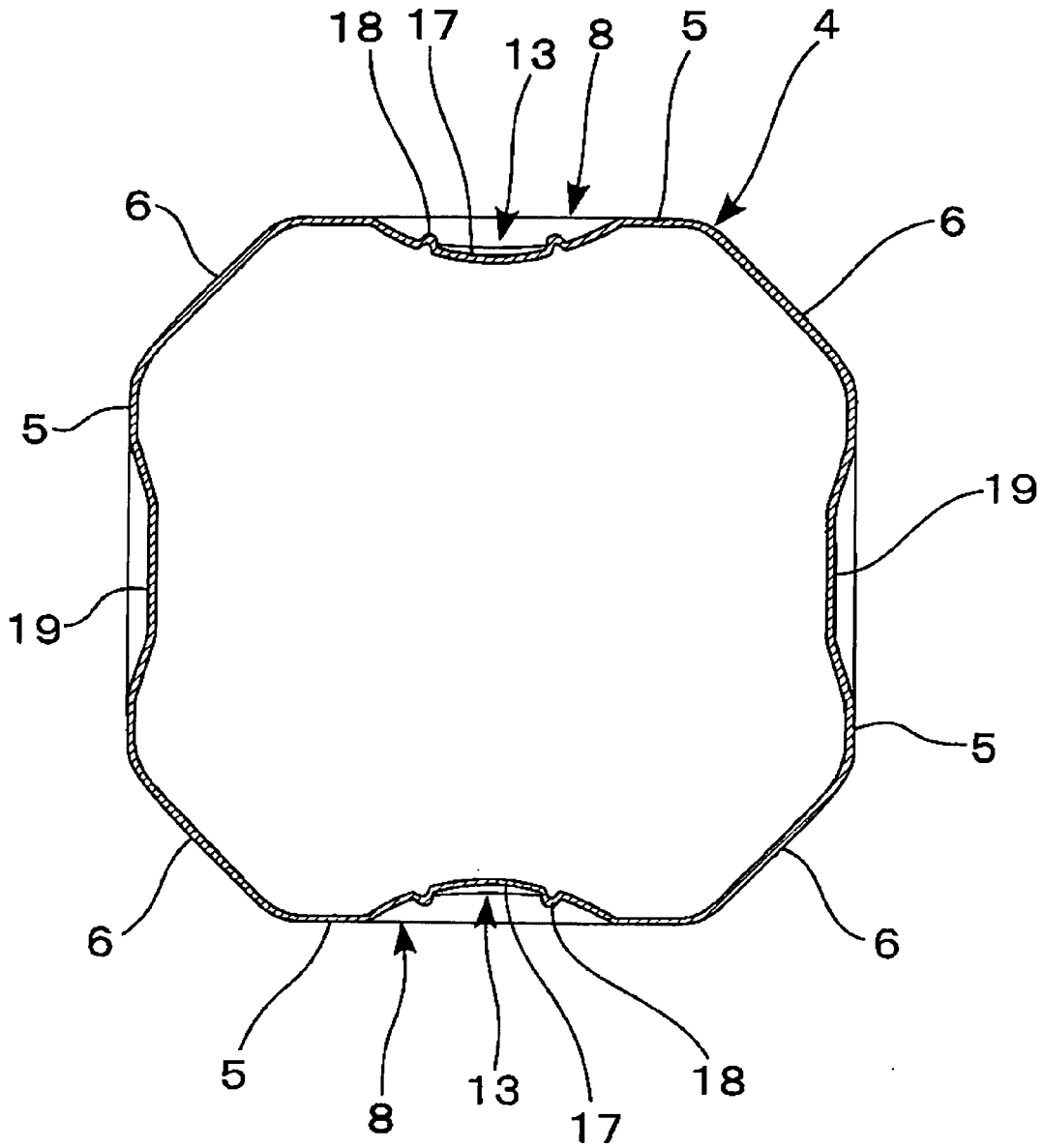
FIG. 8 is an enlarged cross-sectional view of a body wall, taken from line E-E shown in FIG. 6.

FIGS. 1-5 show a grip 8 in the first preferred embodiment, and FIGS. 6-8, a grip 8 in the second preferred embodiment. Both types of grips 8 differ only in the structure of the auxiliary recession 13.

The main recession 9 of each grip 8 (See FIGS. 1, 3, 4, 6, and 7) comprises a surrounding bank 10, which becomes reduced in size as it slopes down, and a most recessed wall 11, which is the bottom of the main recession 9 and is connected to a lower edge of the surrounding bank 10. The main recession 9 has a larger depth than the waist portion 7.

The surrounding bank 10 of the main recession 9 serves as the first finger-stop mechanism where the tips of the thumb and either the index finger or the middle finger entering this main recession 9 are stopped from sliding upward and laterally]. As a means of reinforcing the finger-stop action of the first finger-stop mechanism, two surrounding ridges 12, low in height, are laid in parallel on the surface of the most recessed wall with which the thumb or a finger comes in contact.

When the thumb and either the index finger or the middle finger are placed in the main recessions 9], the fingertips are stopped by the surrounding bank 10, and the cushions of the thumb and a co-working finger are naturally set in the waist portion 7. In that state, the hand would fit nicely with the bottle 1.

The auxiliary recession 13 of each grip 8 is formed integrally with the main recession 9 in a shape extending downward, but at a smaller depth than the main recession 9. In the case of the first embodiment shown in FIGS. 1 to 5, the auxiliary recession, which is vertically long, is disposed in the center in a manner linked to the main recession 9. The first slope 15 is formed peripherally, and the inner second slope 16 is formed around the central recessed wall 14. The first slope 15 and the second slope 16 constitute the second finger-stop mechanism.

In the case of the first embodiment of the auxiliary recession 13, the number of fingers is not specified when fingers are placed in an auxiliary recession 13. It is only necessary for a finger or fingers to be stopped by either one of the first slope 15 or the second slope 16. Any fixed bottle-holding posture of the hand is no longer required, and thus, the hand movement for lifting up the bottle 1 turns out to be quite simple.

FIGS. 6 to 8 show the second embodiment of the auxiliary recession 13. In this case, the auxiliary recession extending downward from the main recession 9 is provided vertically with a concave portion 17 for the middle finger, a concave portion 17 for the medicinal finger, and a concave portion 17 for the little finger, disposed in this order from above. A pair of vertical ridge segments 18 having a small projecting height is disposed in both side areas of each concave portion 17.

In the case of this auxiliary recession 13 in the second embodiment, each concave portion 17 performs the finger-stop action on the fingertip because the concave portion 17 has a dented arc face with which the cushion of a finger fits in perfectly. The vertical ridge segments 18 reinforce the lateral finger-stop action which the arc face has on each fingertip.

[Industrial Applicability]

As described above, each grip is formed by making recessions in the body wall, and is composed of a main recession and an auxiliary recession. Under this construction, the grip having a large depth can be molded conveniently with no trouble. This invention is expected to find many applications in the manufacture of large-size synthetic resin bottles and especially in the field of bottles.

The invention claimed is:

1. A synthetic resin bottle comprising:

a body having flat walls and a groove-like waist portion, the groove-like waist portion: i) being disposed around a middle height of the body, and ii) dividing each of the flat walls of the body into an upper wall and a lower wall; and a pair of grips formed in a pair of opposed walls of the body, each grip comprising:

a main recession disposed so that an upper end of the main recession of the each grip is configured to overlap the groove-like waist portion, while a lower end of the main recession is located in the lower wall of each of the pair of opposed walls, the main recession including:

an entirely surrounding bank that becomes reduced in size as the surrounding bank angles toward an internal part of the container, a most recessed wall, which is at a most recessed part of the main recession, that is connected to an internal edge of the surrounding bank and has a larger depth than the waist portion, and entirely surrounding ridges having a projecting height that are disposed on the most recessed wall and located within the surrounding bank; and an auxiliary recession disposed in an area on a side downward from the main recession, the auxiliary recession having a shape that is different than a shape of the main recession and extending straight from the main recession in a bottom direction, the auxiliary recession including:

a peripherally formed first slope that becomes reduced in size as the first slope angles toward the internal part of the container;

a second slope spaced from the first slope and located within the first slope, the second slope becoming reduced in size as the second slope angles toward the internal part of the container, and a most recessed central wall, which is at a most recessed part of the auxiliary recession, that is connected to an internal edge of the second slope.

2. The synthetic resin bottle according to claim 1 wherein the auxiliary recession has a depth shallower than a depth of the main recession.

3. The synthetic resin bottle according to claim 1 wherein the body has a substantially multi-cornered shape with four flat walls and four corner walls formed by chamfering four corners, each corner wall being disposed so as to connect two adjacent flat walls, and the pair of grips are formed in a pair of flat, long-side body walls that are opposed to each other.

4. The synthetic resin bottle according to claim 1 wherein the auxiliary recession is directly and integrally connected to the main recession, and the auxiliary recession has a vertically long shape.

5. The synthetic resin bottle according to claim 2 wherein the body has a substantially multi-cornered shape with four flat walls and four corner walls formed by chamfering four corners, each corner wall being disposed so as to connect two adjacent flat walls, and the pair of grips are formed in a pair of flat, long-side body walls, opposed to each other.

6. The synthetic resin bottle according to claim 2 wherein the auxiliary recession is directly and integrally connected to the main recession, and the auxiliary recession has a vertically long shape.

* * * * *